US009271532B2

(12) United States Patent
Cole

(10) Patent No.: US 9,271,532 B2
(45) Date of Patent: Mar. 1, 2016

(54) SECURE INVISIBLE GARMENT POCKET

(71) Applicant: Brian Cole, Great Falls, VA (US)

(72) Inventor: Brian Cole, Great Falls, VA (US)

( * ) Notice: Subject to any disclaimer, the term of this patent is extended or adjusted under 35 U.S.C. 154(b) by 373 days.

(21) Appl. No.: 13/731,015

(22) Filed: Dec. 30, 2012

(65) Prior Publication Data

US 2014/0182044 A1 Jul. 3, 2014

Related U.S. Application Data

(60) Provisional application No. 61/679,938, filed on Aug. 6, 2012.

(51) Int. Cl.
*A41D 27/20* (2006.01)
*A41D 1/08* (2006.01)

(52) U.S. Cl.
CPC *A41D 27/20* (2013.01); *A41D 1/08* (2013.01); *A41D 27/205* (2013.01); *A41D 27/208* (2013.01)

(58) Field of Classification Search
CPC ... A41D 27/20; A41D 27/204; A41D 27/205; A41D 27/208; A41D 1/06; A41D 2300/22; A41D 1/08; A41D 27/201; A41F 9/00
USPC ..... 2/247, 250, 236, 237, 248, 227, 252, 2/220, 221
See application file for complete search history.

(56) References Cited

U.S. PATENT DOCUMENTS 239,544 A * 3/1881 Price ..... 2/248
240,841 A * 5/1881 Paul ..... 2/248
530,542 A * 12/1894 Mahon ..... 2/252
1,027,904 A 5/1912 Rogers
1,107,158 A 8/1914 Day
1,210,359 A 12/1916 Pixley
1,642,483 A * 9/1927 Bloomenthal ..... 2/237
2,038,301 A 4/1936 Levi
2,075,680 A * 3/1937 Weinberg ..... 2/247
2,165,081 A 7/1939 Wald
2,359,012 A 9/1944 Sophier
2,599,983 A * 6/1952 Fanning ..... 2/237
2,725,573 A 12/1955 Kornhauser
2,930,046 A 3/1960 Sagner
3,097,365 A * 7/1963 Zins ..... 2/237
3,137,862 A 6/1964 Miserak
4,069,514 A 1/1978 Palmieri
4,139,914 A 2/1979 Tarr
4,428,080 A 1/1984 Takamatsu
4,596,055 A * 6/1986 Aach et al. ..... 2/237
5,067,176 A * 11/1991 Carabillo ..... 2/237
5,165,115 A 11/1992 Stanislaw (Continued)

*Primary Examiner* — Amy Vanatta
(74) *Attorney, Agent, or Firm* — Symbus Law Group, LLC; Clifford D. Hyra

(57) ABSTRACT

A garment has a pocket with an opening located at the waistband of the garment. A strap includes a stretchy membrane and at least one of the opposite ends of the strap extends into openings in the garment to form a horizontal pocket opening. The strap may be made of an elastic material. A fabric can conceal part of the strap and may surround or be attached to the strap. The pocket lining has front and rear walls attached together, with top horizontal portions of the front and rear wall attached behind an exposed portion of the strap. The walls of the pocket lining may be attached to two join seams of the garment. Stretching the strap outwards will open the pocket thus accessing belongings stored therein. When the pocket is closed, the elastic material of the strap provides stretch and recoil, securing any belongings safely inside the pocket.

20 Claims, 12 Drawing Sheets

(56) References Cited

U.S. PATENT DOCUMENTS

| | | | | |
|---|---|---|---|---|
| 5,255,392 | A | 10/1993 | Stanislaw | |
| 6,076,195 | A | 6/2000 | Klein | |
| D447,808 | S | 9/2001 | Ross | |
| 6,363,538 | B1 | 4/2002 | Davis | |
| 6,772,446 | B1 | 8/2004 | Black | |
| 6,880,175 | B2 * | 4/2005 | Tajima et al. | 2/237 |
| 7,500,274 | B1 * | 3/2009 | Kallen | 2/227 |
| 2009/0126079 | A1 * | 5/2009 | Kato | 2/237 |
| 2009/0320182 | A1 * | 12/2009 | Schmalz et al. | 2/237 |
| 2012/0060263 | A1 | 3/2012 | Harber | |
| 2012/0246791 | A1 * | 10/2012 | Weisman | 2/67 |
| 2012/0272433 | A1 * | 11/2012 | Silver | 2/237 |

* cited by examiner

SECURE INVISIBLE GARMENT POCKET

This application claims the priority of U.S. provisional patent application Ser. No. 61/679,938, dated Aug. 6, 2012, which is hereby incorporated herein by reference in its entirety.

BACKGROUND OF THE INVENTION

1. Field of the Invention

The present invention relates generally to garments having pockets, and more particularly to shorts having pockets for use during outdoor, sport, fitness, and exercise activities.

2. Description of Related Art

Virtually every lower body garment has a pocket. However, the typical pocket has remained unchanged for hundreds of years. Pockets are found on all types of lower body garments, such as, but not limited to: sweat pants, track pants, athletic shorts, and skirts. The objects in typical pockets can unintentionally exit the pocket easily. Common objects found in most pockets include, but are not limited to, cell phones, mp3 players, credit cards, membership I.D. cards, cash and keys, all of which are costly to replace if lost or broken from falling out of a pocket. Furthermore, the boom in the market for smartphones has increased the demand for means to safely hold and secure these smartphones when performing activities that involve wearing athletic garments. The typical side seam/hand pocket does not address this problem. The prior art has suffered from not sufficiently advancing a secure pocket that is both easily accessible and functional.

Attempts have been made to provide a pocket on athletic garments that can securely hold valuable belongings while still being easily accessible and fashionable. An example of a pocket system for securing belongings is disclosed in U.S. Design Pat. No. US D654,661 S, to Savage (hereafter referenced as '661). Unlike the present invention, the '661 system's location of the pocket is on the rear of the garment. This location is inconvenient, and requires the user of the garment to twist his/her body to access the pocket. In addition, the location of the pocket in '661 will limit exercises including, but not limited to, abdominal crunches, leg press, bench press, or any exercise that requires lying on a utility bench or on ones back.

Furthermore, the '661 system utilizes a zipper as a means of securing the belongings inside the pocket. This requires the wearer, who cannot see the pocket because of the location of the pocket on the rear of the garment, to blindly locate the zipper slider to open the pocket. Additionally, the teeth of the pocket could scratch objects in the pocket when taken out and or irritate the user's hands while accessing the pocket. In addition, the size of the pocket requires the wearer to take off the many smartphone cases, as they are too bulky to fit in the pocket. Another disadvantage of the '661 system is there is only one pocket located on the garment, and in a very inconvenient area.

Needs exist for improved garment pockets for securing valuables during exertion.

SUMMARY

A new garment in embodiments has a fabric and a strap made of an elastic material. The term elastic, as used herein, relates to the material property (reversible deformation under stress), and does not imply any particular material such as an elastomer or stretchable fabric, although these are examples of materials considered to possess that material property. The strap may extend from the garment (or any fabric sewn or otherwise attached to the garment) and back into the garment (or any fabric sewn or otherwise attached to the garment) to form a horizontal (parallel to the floor/ground) pocket opening. A horizontal opening is least likely to allow an object to be dislodged from the pocket during use. In some embodiments, the pocket opening may be at an angle to horizontal, or even vertical. Because the strap extends into the garment, the strap has a greater range of opening, enabling easy access to belongings located in the pocket. The material around the strap where it extends into the garment may have a low coefficient of friction to ease the sliding of the strap in and out of the garment when it is stretched. When the pocket is in a closed position, the strap may blend into the garment, for example into the fabric on the waistband of the garment, thus making it "invisible". Elasticity in the strap helps it to remain securely closed when worn, thus securing the belongings inside. To open the pocket, a wearer may simply stretch the strap away from his or her body, thus easily opening it.

The waistband of the garment may include an elastic pliable strip of material. The garment may have two generally vertical join seams outlining hip panels on each side of the garment, which the pocket opening can lay between. A stretchy fabric (stretch zone) may be used, and may be sewn or otherwise attached to the two generally vertical join seams, between the respective hip panels and the respective leg sections. The material of the stretch zone provides great elasticity and may be for example elastane, spandex, microfibers, nylon or polyester. The stretch zone offers greater ease of opening and exerts less stress on the garment when the pocket is being opened.

The pocket lining may provide enough stretch that it does not restrict the size of the pocket opening when in the open position. The pocket lining may be for example, but not limited to, elastane, microfibers, nylon, polyester, a waterproof material or a stretchy mesh fabric. A lining that does not provide stretch when force is exerted may restrict the pocket from fully or easily opening. An optional stretchy material may be attached between the front and rear vertical walls of the pocket lining, the stretchy material extending down vertically from the top of the horizontal opening. The optional stretchy fabric may be attached only to the pocket lining, between the front and rear walls, and not to the garment itself.

The present invention is also directed to an athletic garment, in which the user may perform physical activities that with traditional pockets may cause belongings in the pockets to move about in unwanted ways and ultimately unintentionally exit the pocket. Because of a unique pocket entrance with an elastic strap that remains taut to the garment when closed, the belongings in the pocket remain inside during athletic activities.

An object of the present invention is to provide a pocket that securely holds belongings for an individual. The standard pocket of most athletic garments creates an opportunity for objects to easily fall out of the pocket. This problem is solved by a unique strap that remains securely closed during use. The pocket may hold valuables and other items such as, but not limited to, credit cards, membership or I.D. cards, keys, and cash, which are all light objects that could easily exit a standard side seam/hand pocket without the user knowing. With the Secure Invisible Garment Pocket, objects inside will not exit the pocket; thus, the user does not need to worry about losing valuable belongings.

Another object of the present invention is to create an illusion that the garment does not have a pocket. The strap may be located on the waistband of the garment. Because of the location of the strap, the strap may blend into the garment while the pocket remains closed. Nevertheless, opening the pocket is an easy task. An advantage of the new pocket is that it allows garments that do not usually have pockets because they get in the way during physical activities, such as basketball, running and lacrosse shorts, to have pockets. Pockets may typically be excluded to avoid a hand or other foreign object entering the pocket and ripping the pocket during game play, or at least interfering with game play. The entrance of the new pocket may be located with the pocket opening horizontal on the side of the waist, not vertically on the thighs like the majority of athletic wear pockets where the pocket may be easily ripped during physical activities.

The new pocket may be any size, thus the pocket may be formed to the size of a cell phone/smart phone/mp3 player or electronic device of choice. The present invention may secure valuables and costly electronics, which can be easily damaged, to the side of the waist with minimal to no movement. Such a pocket is ideal for safely keeping important electronic devices in an easily accessible location during, for example, jogging, running and other types of physical activities.

The new pocket also may allow individuals who enjoy listening to music during physical activities to listen to their music while knowing their smartphone/mp3 player or electronic device of choice is safe from falling out of the pocket when moving around during physical activities. This new pocket may eliminate the need for mp3 player armbands that are used for physical activities. Many armbands require the user to take off the casing of the electronic device before placing it in the armband pouch. This is inconvenient for the wearer. Furthermore, using the electronic device (changing song, texting, browsing the web) while using the arm band is inconvenient, difficult and requires the user to take the armband off and furthermore, take out the electronic device from the actual armband case itself. Additionally, many individuals, especially women, don't like having a band strapped around their arm while performing physical activities (for a woman these arm bands can take up half their arm and are considered by some to be not stylish), as it can reduce blood flow, create an unwanted rash and limit muscle contraction.

Yet another object of the present invention is to prevent objects in pockets from swinging back and forth, side to side, and up and down when performing physical activities. The pocket lining may be sewn to the two vertical join seams to minimize object movement in the pocket, ideal for, for example, running, jogging and walking. Attaching sides of the pocket to garment seams prevents excessive movement of the pocket during athletic activities, reducing wear on the pocket and discomfort for the wearer as well as potential damage to the pocket contents.

The new pocket may be located on the side of the wearer's waist. Many standard athletic garments have the opening of their pockets located on the upper thigh. Thus, once objects are placed in the pocket, they lie directly on the front of the thighs. Such objects can get in the way when performing athletic tasks such as, but not limited to, dumbbell press, lat pull-down (pads that hold thighs and prevent body from rising get in the way of the objects in standard pockets), lying hamstring curl, deadlift, barbell shrugs, hang clean and many other various exercises. Embodiments of the present invention solve that problem. The pockets may be located on the side of the waist, thus eliminating the problems of a side seam/hand pocket.

A new garment has a main portion and a pocket including a pouch and an elastic strap. At least one end of the elastic strap extends into an opening in the main portion, and the elastic strap is secured to the main portion. The elastic strap may be secured thereto by direct attachment such as stitching, or may for example be looped through a fabric tunnel in the main portion such that it is secured by the main portion, although not attached to it. The opening of the pocket is formed between a portion of the elastic strap that does not extend into the opening and the main portion of the garment, and the top of the pouch is attached on one side to the main portion and is operably connected on the opposite side to the elastic strap such that the opposite side moves together with the elastic strap. Thus, the opposite side need not be attached directly to the elastic strap, but may be connected to a cover for the strap or similar, in a way that causes the pocket to move outward with the elastic strap when the pocket is opened.

The main portion may include a right hip panel and right leg section and at least two vertical join seams attaching the right hip panel to the right leg section, and a left hip panel and left leg section and at least two vertical join seams attaching the left hip panel to the left leg section. The top of one of the hip panels may be operably connected to the elastic strap such that the hip panel moves together with the elastic strap, as described above for the opposite side of the top of the pouch. The top horizontal width of one of the hip panels may be equal to or within 20% of the width of the exposed portion of the strap that is not inside the opening in the main portion. The elastic strap may include a section of inelastic material and a stretchy membrane. The stretchy membrane may be concealed by fabric.

The opening in the main portion may be located on a waistband of the main portion. The main portion may include a waistband, which may have an elastic strip of material. The waistband may also include a drawstring. The ends of the strap may be attached to the main portion by stitches securely connecting the ends of the strap to the waistband of the main portion—which may also include a covering fabric. The garment may also have pieces of flexible fabric between the front side of the each hip panel and the front side of each respective leg section, and between the rear side of each hip panel and the rear side of each respective leg section. Top portions of each piece of flexible fabric may be attached to a waistband of the main portion.

The garment may be a pair of shorts, running pants, training pants, track pants, sweatpants, basketball pants, running capris, yoga pants or an athletic skirt. A stretchy material may be attached between front and rear sides of the pouch, the stretchy material extending down from the top of the opening. The sides of the pouch may be attached to the two join seams or an inner lining of the main portion. The opening of the pocket may be configured to be parallel to a surface stood on by a person wearing the garment. There may be one or more slits in the main portion where the main portion meets the strap that allow the strap to extend farther away from the user's body. For example, there may be vertical slits (or slits at an angle to vertical) in the main portion extending from the edges of the area where the main portion meets the strap. When the strap is pulled outward, it pulls the part of the main portion that is connected to it outward as well. This force pulls the top edges of the slit away from each other, and thus the slits allow the main portion and therefore the strap to extend further outward than would otherwise be possible, allowing for a larger pocket opening.

A new lower body garment includes a main portion and at least one pocket having a band. At least one end of the band extends into a slit in the main portion, and the band is secured to the main portion. A section of the band that does not extend into the slit forms part of the opening of the pocket and the pocket includes a liner having a first face and a second face, where the upper section of the first face is secured to the section of band that does not extend into the slit, and the upper section of the second face is secured to an adjacent section of the main portion that is located behind the section of band that does not extend into the slit. The first face may be secured directly to the band, or for example to a material covering the band, in such a way as to move together with the band when it is extended outwards. The right and left leg pieces may include a polyester material. An exterior fabric may cover the section of band that is visible and that creates the pocket.

BRIEF DESCRIPTION OF DRAWINGS

The aspects of the present invention will become more apparent by describing in detail non-limiting embodiments thereof with reference to the attached drawings, in which.

DETAILED DESCRIPTION

A new secure invisible garment pocket keeps the wearer's belonging securely in his or her pocket, for example, but not limited to, keys, credit cards, membership I.D. cards, money, mp3 players or cell phones. The following description refers to the use of a pair of athletic shorts that use the secure invisible garment pocket for enhanced comfort, style and confidence that belongings located in the pocket are safe from unintentionally exiting the pocket, which still offers easy access to the belongings. However, it will be understood that this invention may be used in any other desirable application for example for sweatpants, athletic pants, skirts, and any other lower body garment. It also may be adapted for use with upper body garments such as jackets and shirts.

Figure 1:
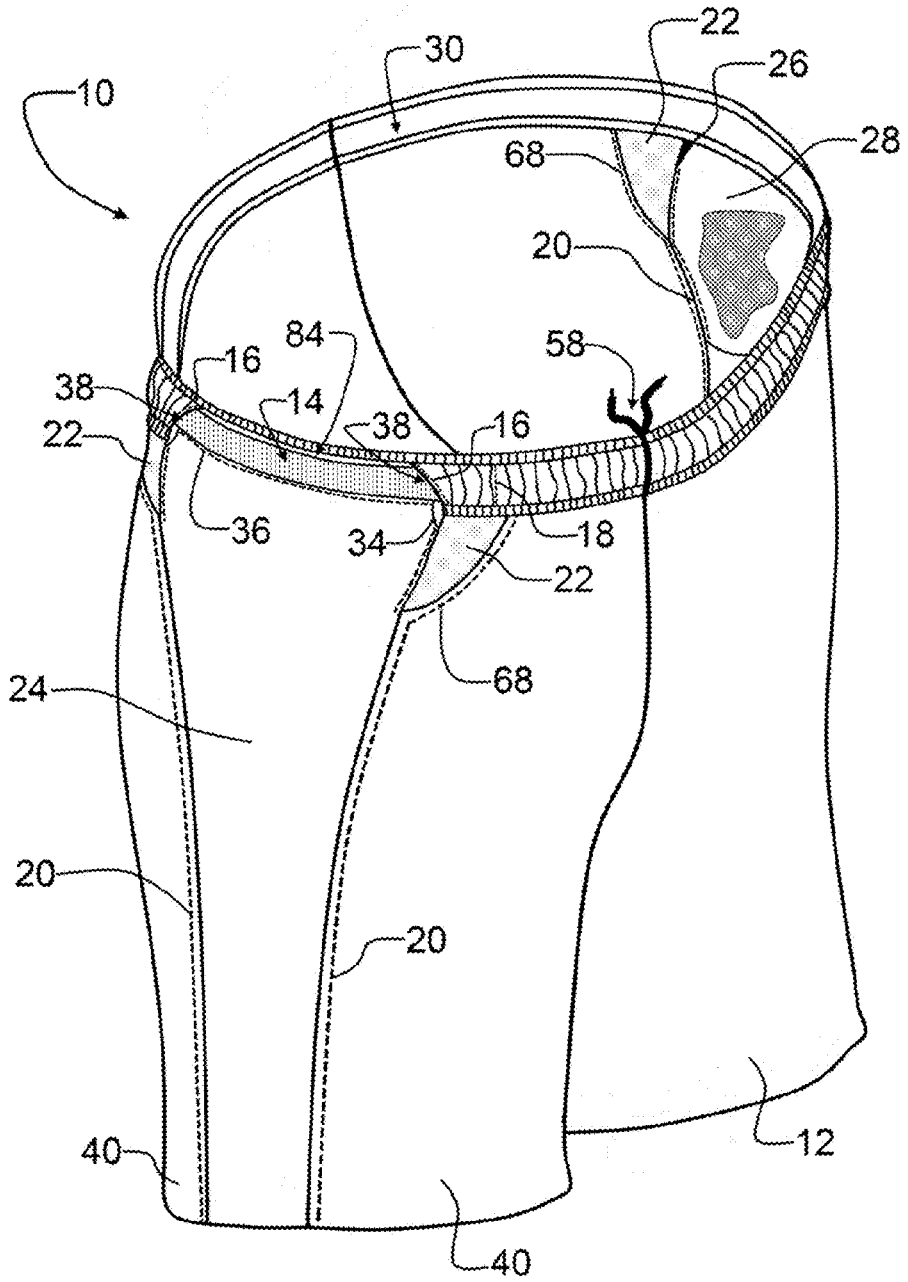
FIG. 1 is a perspective view of a garment with a pocket in a closed position, in an embodiment.
Figure 6:
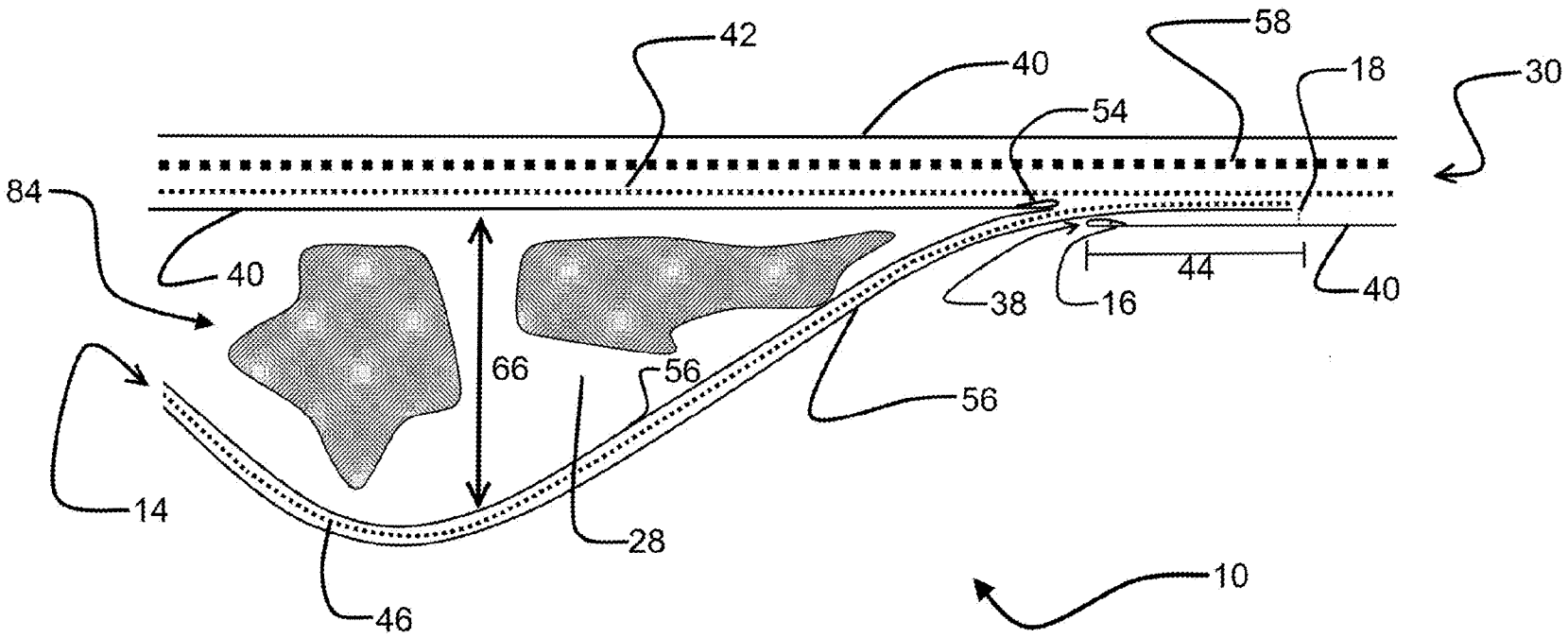
FIG. 6 is top view of the right side pocket on the garment in an opened position, in an embodiment.

FIG. 1 depicts a garment 10 according to an embodiment of the present invention. In the embodiment shown in FIG. 1 a garment 10 has left and right leg sections 12, 40 and a strap 14 which enters a fabric opening 38 of the garment 10 and is sewn or otherwise attached 18 to the garment 10 to form a horizontal pocket opening 84. Although the fabric opening 38 is shown on the waistband 30 of the garment 10, in other embodiments the fabric openings 38 may be located anywhere on the garment. However, the waistband is a desirable location for the pocket because of its relative ease of access in combination with the strength and durability of the material there and the tightness of the garment around the wearer's body there, which helps to prevent the garment from moving when the user opens the pocket and the strap 14 exerts force on the garment where it is connected/supported. The fabric of both the left leg section 12 and the right leg section 40 of the garment 10 may be, but is not limited to, polyester, elastane, microfibers, and/or nylon and may include a moisture-wicking fabric, for added comfort during physical activities. The strap 14 may be sewn or otherwise attached 18 to the fabric and/or the waistband 30 of the garment 10, which may include an elastic pliable strip of material 42 (FIG. 6).

The dashed lines in FIG. 1 are provided to show the location of the join seams 20 in this embodiment. The join seams 20 can be located wherever the manufacturer/designer intends, and may depend on the horizontal width of both the exposed strap 14 and the hip panel 24. FIG. 1 depicts one example of two join seam 20 locations. There may be at least one or no join seams on each side of the garment 10. However, in some embodiments two join seams 20 run in a generally vertical direction from the bottom of the garment 10, and may run around the optional stretch zone fabric 22. The optional stretch zone fabric 22 may be made of a fabric that provides great elasticity/stretch, such as, but not limited to, elastane, microfibers, nylon, spandex or polyester. The stretch zone fabric 22 offers greater ease in opening the pocket where, as in the embodiment shown, the hip panel is operably connected at its top to the strap 14 and therefore to the pocket opening, while exerting less stress on the garment 10. Hip panels 24 that run between the two generally vertical join seams 20 may be made of a fabric that provides great stretch and moisture-wicking properties. Inside the garment 10, the vertical side walls of pocket linings 28 may be sewn or otherwise attached to both join seams 78 (FIG. 9A), 20 to ensure minimal movement while performing physical activities. An advantage of utilizing existing seams for attaching the pocket to the garment is that no additional visible seams are created that would alter the external appearance of the garment. However, in embodiments where the pocket is not placed near existing seams, it may be attached directly to the garment fabric or an inner lining. The fabric of the pocket lining 28 may be, but is not limited to, elastane, microfibers, nylon, polyester, waterproof material, or a stretchy mesh fabric.

Figure 2:
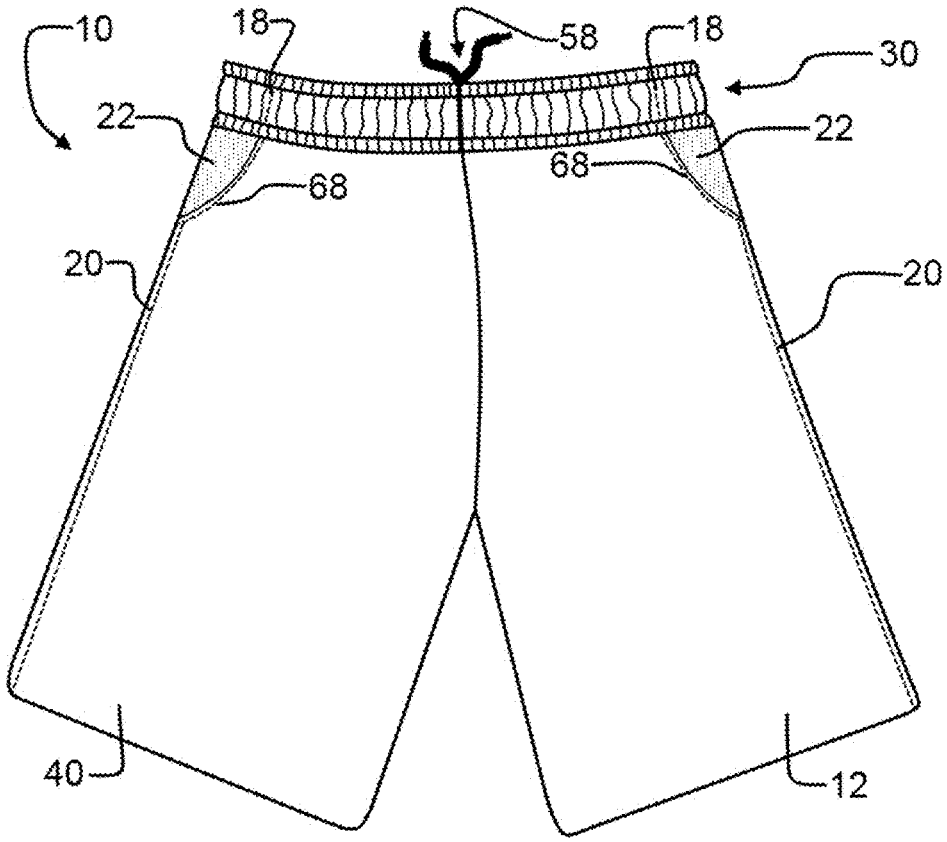
FIG. 2 is a front elevation view of the garment, in an embodiment.

FIG. 2 illustrates a front elevation of a typical embodiment of a garment 10. The illustration is displaying one example of the join seams 20 of the garment 10. The join seams 20 may be sewn 68 around the optional stretch zone fabric 22. The stretch zone fabric 22 provides greater stretch when the pocket is opened. This optional stretch zone fabric 22 ensures the user can comfortably open the pocket with minimal stress on the garment 10. The inner material of the waistband 30 may be, but is not limited to, elastic (woven or braided), polyester, polyester rubber elastic, nylon elastic, spandex or any other material that provides comfort while remaining firmly placed around the waist of the wearer. The width of the waistband 30 may be, but is not limited to, 1.0-3 inches.

Figure 3:
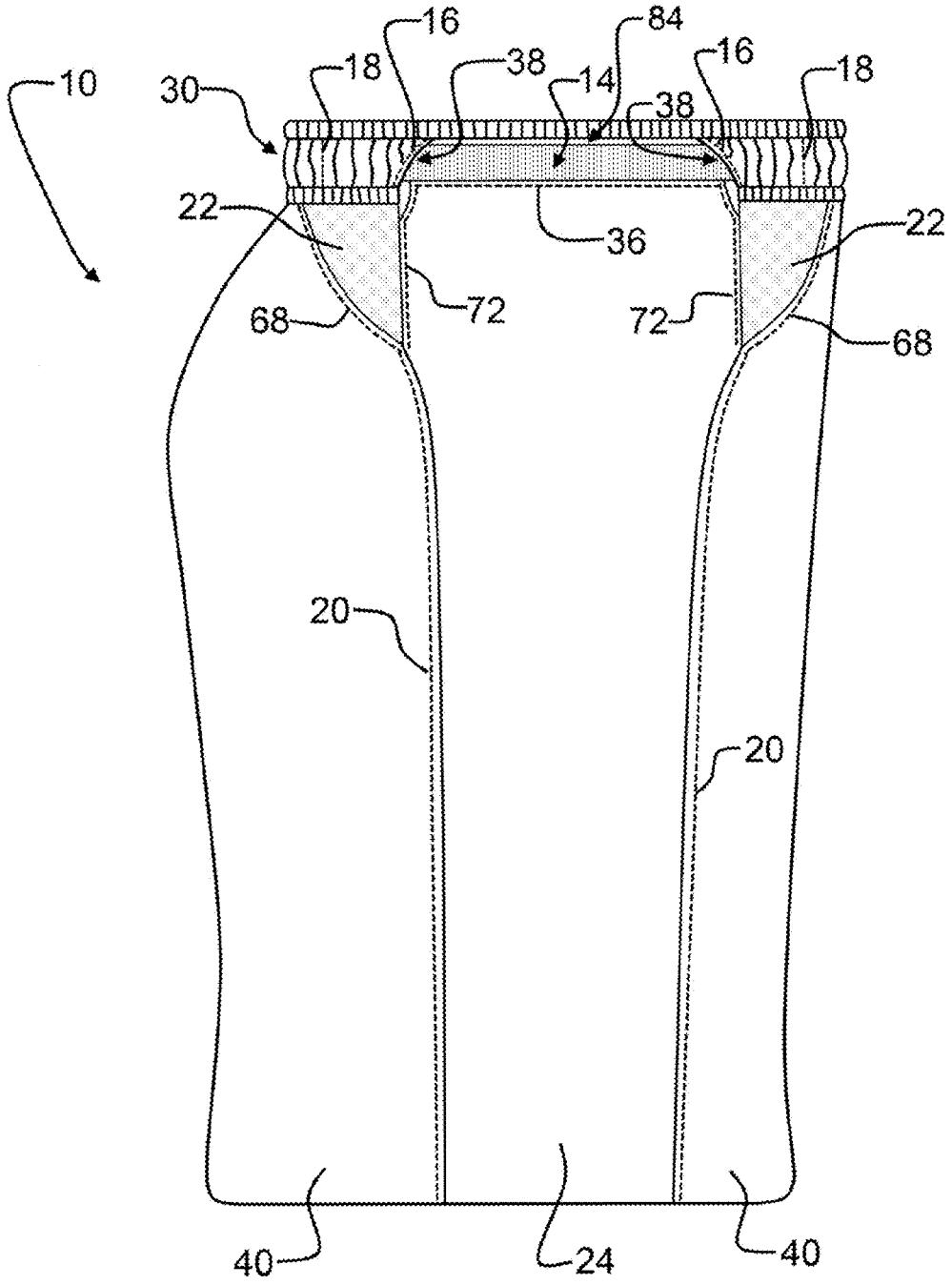
FIG. 3 is a right side elevation view of the garment, in an embodiment.

FIG. 3 depicts the right elevation view of the garment 10 having a right leg section 40. The front of the garment 10 is located towards the right of the Figure and the rear of the garment 10 is located towards the left side of the Figure. The left elevation is a mirror image of the right elevation. FIG. 3 shows the strap 14 located on the garment 10. Horizontal pocket opening 84 may be located on the sides of the hips of the garment 10 where one's arms would normally rest at the sides of the waist, when in a standing position. Although, the pocket location is given as an example, it will be appreciated that other locations on the garment 10 may be used. The exact location of join seams 20 may vary depending on the exposed horizontal width of the exposed strap 14 and the horizontal width of the hip panel 24. The hip panels 24 may be located between the two vertical join seams 20 and may be sewn or otherwise attached 36 to the strap 14 or to a fabric or other covering of the strap. The hip panel 24 may be made of the same fabric as the right and left leg sections 40, 12, or a fabric that provides great stretch and moisture-wicking properties, to keep the belongings of the individual safe from perspiration. The horizontal width of the exposed strap 14 may dictate the horizontal width of the hip panel 24, where the top horizontal width of both right and left hip panels is approximately the same width as that of the exposed portion of the strap that creates at least one horizontal pocket opening. Alternatively, the pocket opening could be smaller than the width of the hip panel 24, in which case the pocket would benefit from the use of stretch zones similar to the shown stretch zone fabric 22 in the hip panel 24 adjacent to where it operably connects to the strap 14 so that expansion of the pocket opening does not tear the hip panel 24 and opening the pocket is not too difficult.

If the optional stretch zone fabric 22 is used, the hip panel 24 may be sewn or otherwise attached 72 to the stretch zone fabric 22. The hip panel 24 may be sewn or otherwise attached to the left leg section 12 and the right leg section 40 of the garment 10 at the location between the two join seams 20. The strap 14 may enter the fabric opening 38 of the garment fabric, or any fabric sewn or otherwise attached to the garment 10. There may be a seam 16 at the fabric opening 38, to prevent fabric threads from falling apart during use and to provide a finished look. The vertical length of the opening of the fabric 38 may be greater than or equal to the vertical length of the strap 14, to allow for easy opening of the pocket and retraction of the strap into the fabric opening 38.

Figure 4:
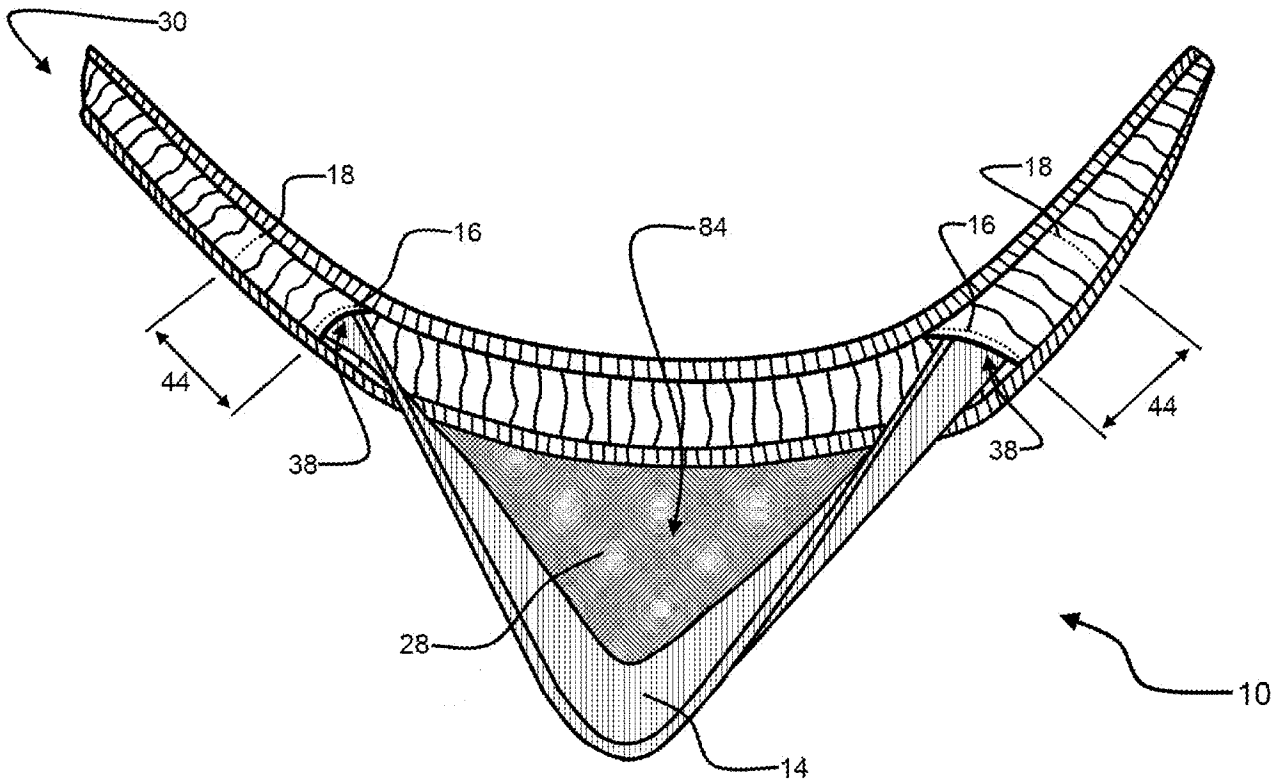
FIG. 4 is an enlarged detail view of a pocket contraption in an open position from the perspective of a wearer of the garment looking down on it, in an embodiment.

Turning to FIG. 4, the pocket opening is shown in an enlarged detail view of the strap 14 in an open position, as if the wearer of the garment 10 is looking down upon it, opening it with his/her hand. The opening in the fabric 38 allows the strap 14 to enter the garment 10, to form a horizontal pocket opening 84. Opposite ends of the strap extend into the garment and can be sewn or otherwise attached 18 to the elastic material 42 (FIG. 7), or sewn or otherwise attached 18 to the garment fabric or any other fabric sewn or otherwise attached to the garment 10. The strap 14 may extend for example 0.25-20 cm from the point of entrance into the fabric opening 38 to the point of attachment 18 to the elastic waistband material 42 (FIG. 7) or may be attached in any way to the garment 10, including attached to any material sewn or otherwise attached to the garment 10. In some embodiments, the strap 14 forms a complete loop around the waist of the garment and is supported by material covering the waistband but is not attached to the garment at any point.

Figure 5A:
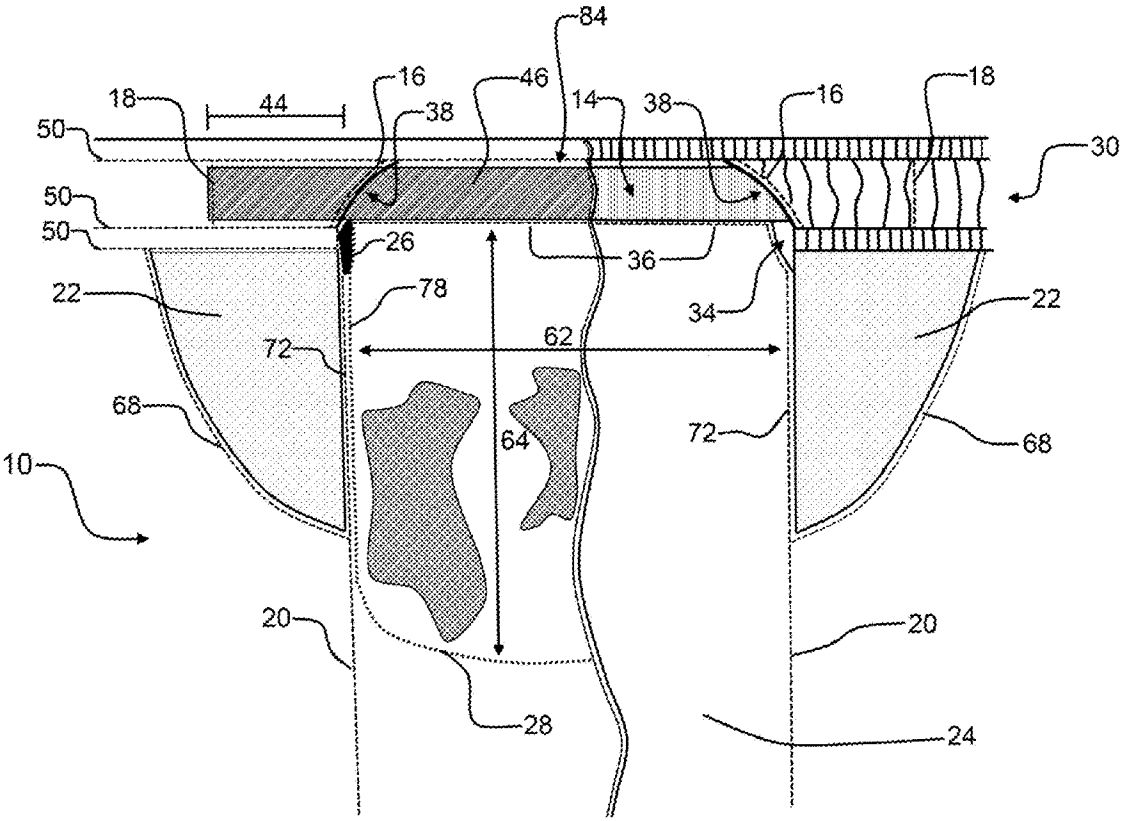
FIG. 5A is an enlarged sectional view of the pocket contraption, in an embodiment.

FIG. 5A illustrates an enlarged sectional view of a typical embodiment of the garment 10. As shown in FIG. 5A, the strap 14 enters the fabric opening 38 and is sewn or otherwise attached 18 to the elastic waistband material 42 (FIG. 7) or attached in any way to the garment 10, including attached to any material sewn or otherwise attached to the garment 10. The stitch 18 that attaches the strap 14 to the garment 10 may be, but is not limited to, a zigzag stitch, straight stitch or running stitch. The strap 14 may include an elastic membrane 46 (FIG. 7), as an elastic membrane provides stretch and recoil. Although, this material is given as an example, it will be appreciated that other materials known in the art can be used, that achieve the same results.

There may be a fabric 56 (FIG. 7) that covers the strap 14 and it may be made of the same material as the garment fabric 10, or any other fabric that maintains the function of the strap 14, including the same fabric as the hip panel 24. The three horizontal stitches 50 located on the waistband 30 of the garment 10 secure the leg section fabric, which is wrapped around the waistband, to the waistband 30. The spacing of the horizontal stitches 50 may vary depending on the design of intended garment 10. However, there may be a spacing of 1.25 inches between any two of the horizontal stitches 50 at the fabric opening 38, or in any case sufficient spacing so that the strap 14 has enough vertical space to enter the fabric opening 38. A seam 68 runs the curved perimeter of the optional stretch zone fabric 22 which connects to the join seams 20, the waistband 30 and the hip panel 24. The front wall 60 (FIG. 9A) of the pocket linings 28 may be sewn or otherwise attached to the strap 14 (or to strap-covering material, or other material that moves together with the strap 14, so that it is operably connected to the strap 14) and the rear wall 70 (FIG. 9A) may be sewn or otherwise attached to the adjacent fabric situated behind the exposed strap. In the Figures, the rear wall 70 (FIG. 9A) is sewn to the leg section fabric located on the waistband 30. The pocket lining 28 may also be sewn or otherwise attached 78 (FIG. 9A) to the two join seams 20, to prevent movement of objects in the pocket. The size of the actual pocket's horizontal length 62, width 66 (FIG. 6) and depth 64 may vary depending on a desired use of pocket and the horizontal width of the exposed strap 14.

Figure 5B:
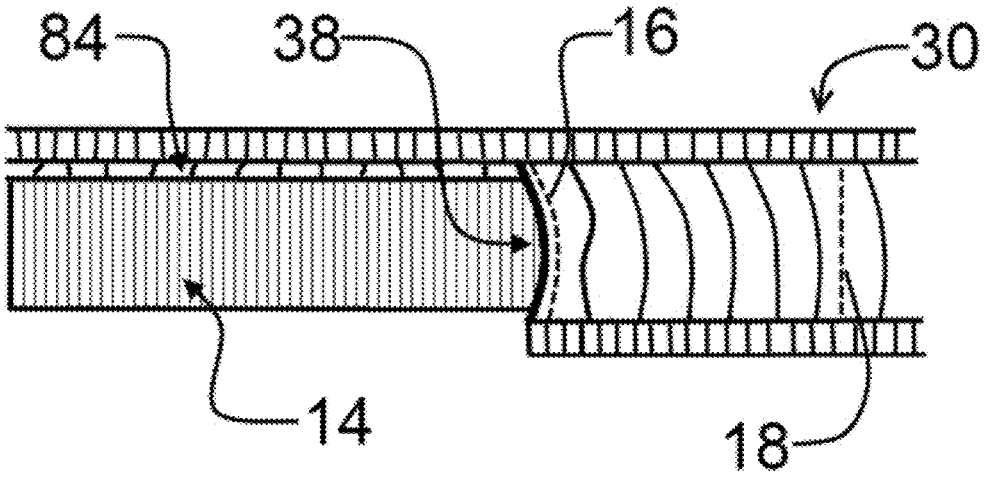
FIG. 5B is an enlarged view of a fabric opening in an alternative embodiment.

FIG. 5B illustrates another embodiment of the fabric opening 38, which conceals part of the strap 14. FIG. 5B depicts the fabric opening 38 as a vertical opening as opposed to a slanted opening. A vertical opening 38 in the fabric may be used. However, there may be some angular slant for the fabric opening 38.

FIG. 6 depicts a top view of a secure invisible garment pocket, in an embodiment, on the right side of the garment 10. The strap 14 here includes an elastic membrane 46, and contains a fabric 56 covering the elastic membrane 46, however, in other embodiments the covering fabric is not required. The fabric opening 38 allows the strap 14 to enter the waistband 30 of the garment 10. It will be understood that the strap 14 may not need to enter the waistband 30 of the garment 10. In fact, in some embodiments the strap 14 may be attached at its ends to the outside of the garment, and not enter the garment at all, although this results in a more noticeable appearance. In such embodiments, the strap 14 may be passed through loops of fabric or similar near the edges of the pocket opening to keep the strap 14 close to the garment 10 during opening, or may be allowed to extend away from the garment 10.

Nevertheless, the strap 14 may enter a fabric sewn or otherwise attached to the garment 10, which may include the fabric covering the waistband. In a typical construction, right and left leg sections 40, 12, wrap over and cover an elastic waistband loop. The stitching of the wrapped leg section fabric to the waistband elastic in its stretched condition, and subsequent release and contraction of the waistband elastic, result in the classic scrunched waistband look. This construction is shown in FIG. 6, with right leg section 40 located on the waistband 30. In the embodiment shown in FIG. 6, the waistband 30 includes a waistband covering fabric, shown in FIG. 6 as the right leg section 40, which wraps around the elastic pliable material 42 and a drawstring 58. The garment 10 may require a drawstring 58. The drawstring 58 may not interfere with the stitching 18 that firmly attaches the strap 14 to the garment 10.

The strap 14 may be sewn or otherwise attached 18 to the elastic band 42 and/or the fabric covering the waistband (which may be leg section fabric extending up and wrapped around the elastic band 42), shown in FIG. 6 as the right leg section 40. The strap 14 may also be sewn or otherwise attached to any fabric that the strap 14 extends into, thus concealing part of the strap 14. The depth 44 of the strap 14 may be, but is not limited to, 0.25-20 cm from the fabric opening 38 to the point of attachment, where it is sewn or otherwise attached 18 to the garment 10, to form a horizontal pocket opening 84 between fabric openings 38. In some embodiments, the strap 14 may loop all the way around the waistband/garment, and may not be attached at all but merely supported within the waistband covering fabric. The waistband covering fabric, shown in FIG. 6 as the right leg section 40, adjacent to the strap 14, may have a seam 54 to prevent the first fabric from tearing during the life cycle of the garment 10.

Figure 7:
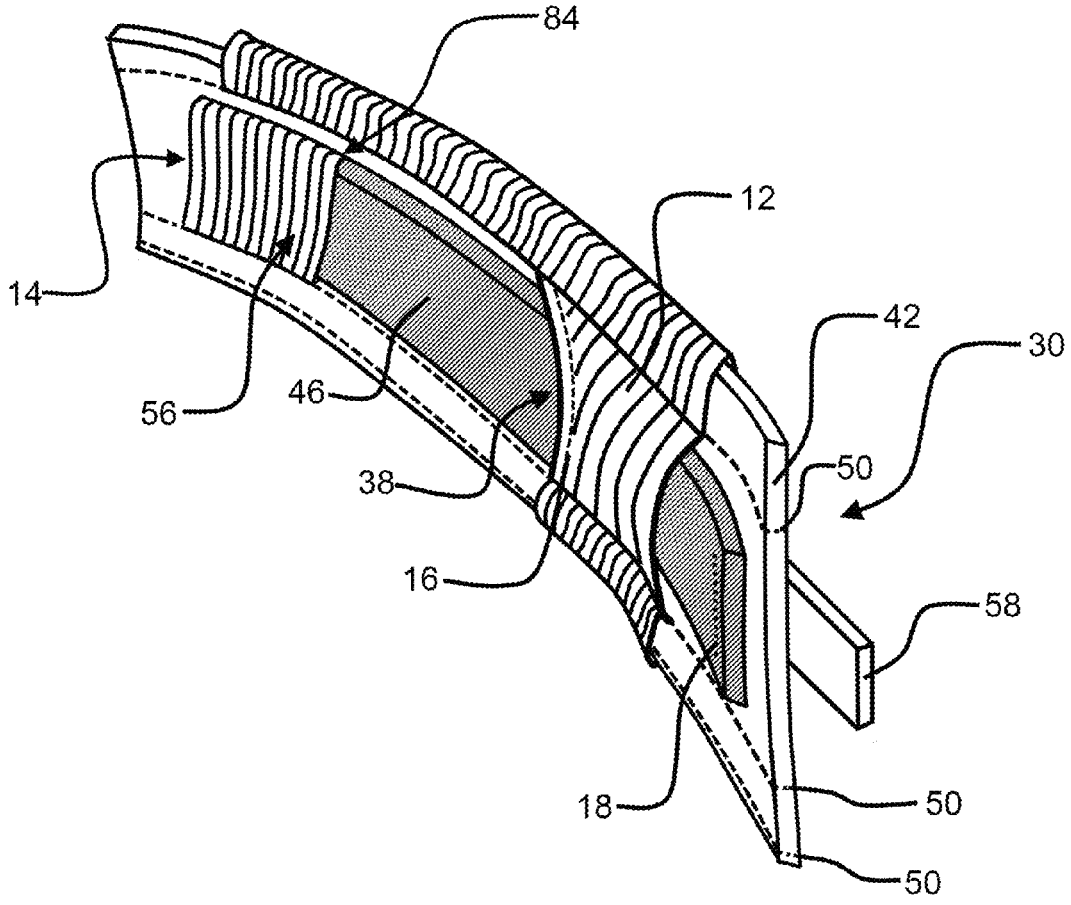
FIG. 7 is a sectional view of the waistband where the strap connects to the garment, in an embodiment.

FIG. 7 depicts a close-up sectional view of the waistband 30, in which the strap 14 may be sewn or otherwise attached 18 to the elastic band 42. The fabric of the right and left leg sections 40, 12 (shown in FIG. 7 as the left leg section 12) or any other fabric of choice may wrap around the drawstring 58 and the elastic band 42 to cover the waistband. This fabric is sewn or otherwise attached using for example horizontal stitches 50, on the waistband 30. Although there are three horizontal stitches 50 running across the waistband 30 as an example, it will be appreciated that more or less horizontal stitches can and may be used to achieve the same functions. The horizontal stitches 50 run through the first fabric and the elastic band 42. The strap 14 shall be sewn or otherwise attached 18 to the elastic band 42 or the first material, shown in FIG. 7 as the left leg section 12, or any material attached to the garment 10 that the strap 14 extends into.

Figure 8A:
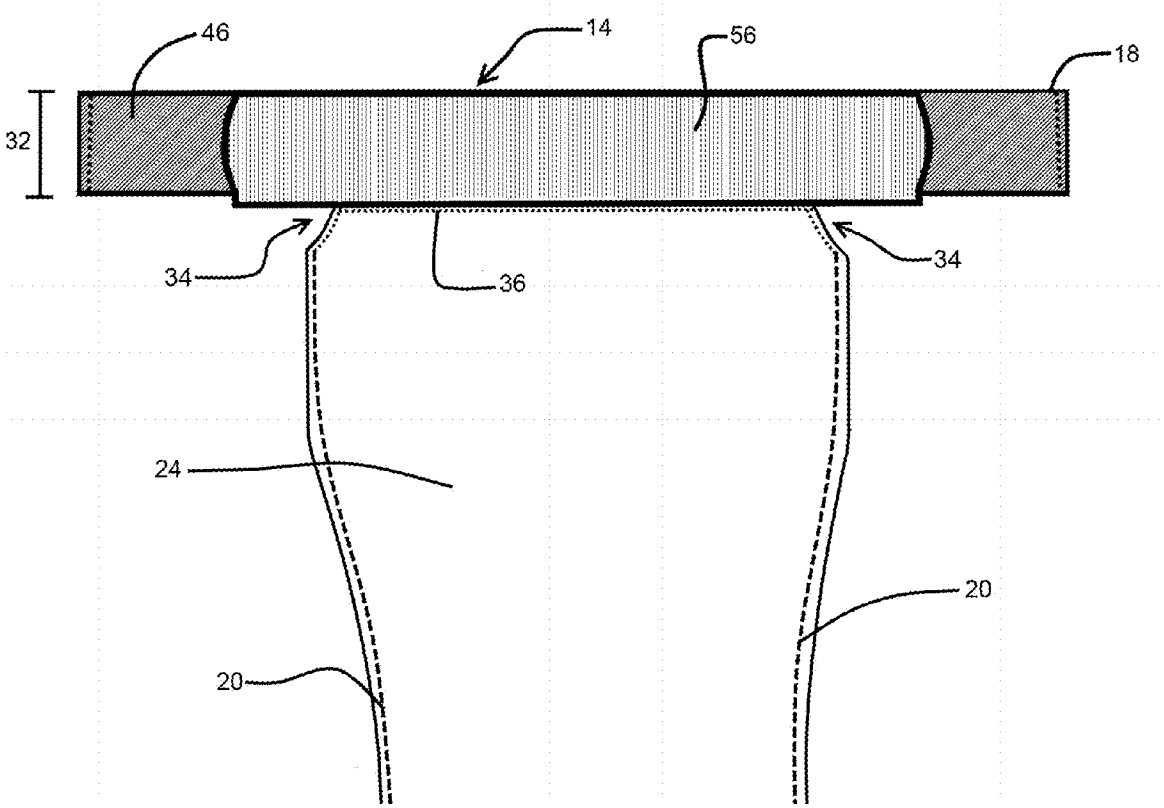
FIG. 8A is a front view of a strap and a hip panel, in an embodiment.

FIG. 8A depicts a front view of the strap 14 and the hip panel 24 located between the two join seams 20. The hip panel 24 that runs between the two join seams 20 may be, but is not limited to, a fabric that provides great stretch and moisture-wicking properties. Here, the hip panel 24 is sewn or otherwise attached 36 to the strap covering fabric 56. In other embodiments, the hip panel 24 may be sewn directly to the strap 14 or to some other material that moves with the strap 14. As the pocket is located on the outside of the garment, attaching the strap to the outer material of the garment, directly or indirectly, results in a continuous appearance when the strap is extended away from the garment and prevents any objects from getting between the pocket and the outside of the garment. For other pockets not located adjacent the hip panel, the strap or strap cover material may be attached to a leg section, or for an interior pocket, may not be attached to the garment at all except at its ends (or not even there, for a continuous loop strap). The hip panel 24 may be made of the same type of material as both the right and left leg sections 40, 12 of the garment 10. The fabric 56 that covers strap 14 may not cover the entire strap 14. For example, in FIG. 8A the strap covering fabric of choice 56 that surrounds the elastic membrane 46 does not cover the entire elastic membrane 46. The fabric 56 covering the strap 14 may be sewn or otherwise attached 52 to the strap 14 or it may just cover and surround the strap with no physical attachment to the strap at all. There may be a slit 34 between the hip panel 24 and leg section at the top of the hip panel 24 where the hip panel 24 attaches to the strap 14. This slit 34 allows the pocket to open with greater range and ease, as it allows the hip panel to be pulled away from the leg section. The width 32 of the strap 14 may be, but is not limited to, about 1-4 cm. However, it will be known that the present invention does not limit the width of the strap 14. It will also be appreciated that there may not be a fabric covering the preferably elastic membrane 46.

Figure 8B:
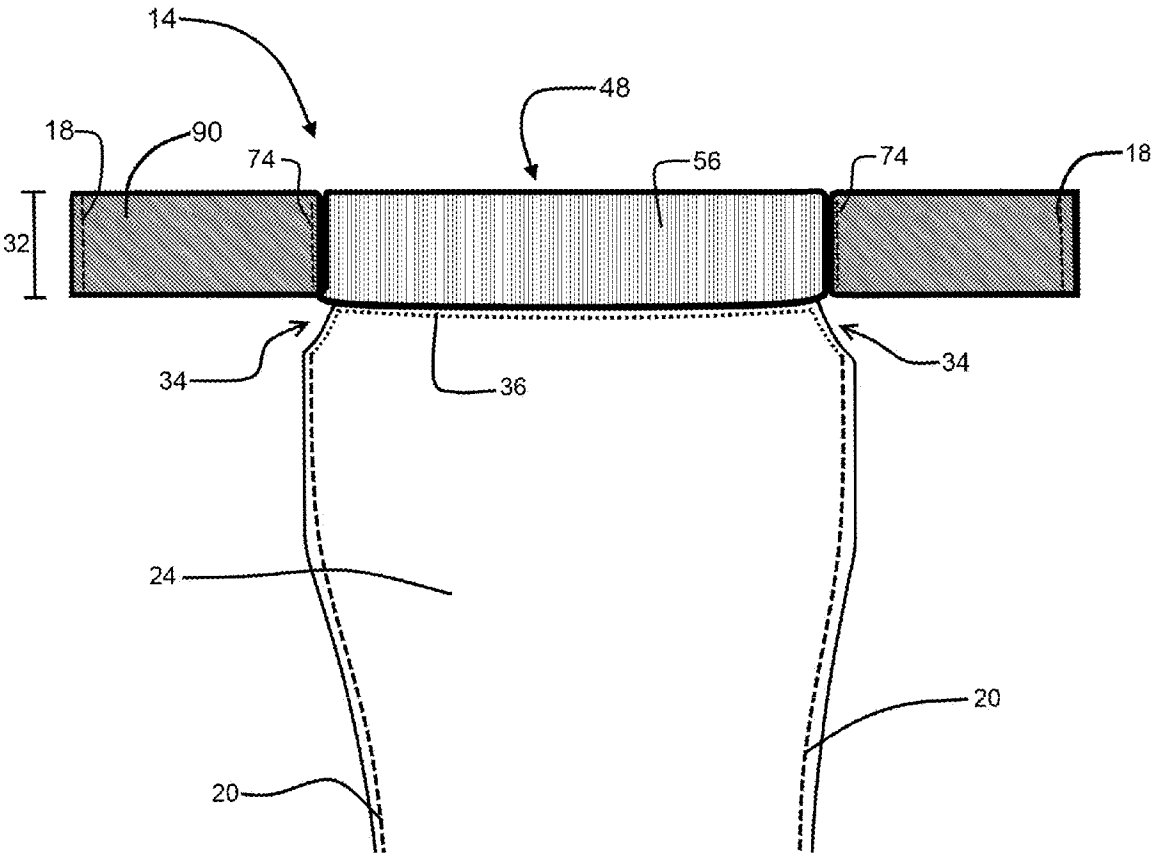
FIG. 8B is a front view of the strap and hip panel in an alternative embodiment.

FIG. 8B is a front view of another embodiment of the strap 14. The hip panel 24 is shown here sewn or otherwise attached 36 to the strap 14, but in other embodiments may be attached to a fabric covering strap 14 or similar. The hip panel 24 may be made of the same fabric as the right and left leg sections 40, 12 of the garment 10. The fabric 56 of choice that covers strap 14 may not cover the entire strap 14. This alternative embodiment of the strap 14 has an elastic membrane 90 sewn or otherwise attached 74 to exposed, non-elastic membrane 48 to form the complete strap 14. The elastic membrane 90 may have the same fabric 56 covering it, although it is not shown in FIG. 8B. The strap 14 may also be covered by the same fabric of the hip panels 24. The strap 14 need not be covered at all by fabric 56, depending on the desired appearance. The strap may enter a fabric opening 38 (FIG. 5A) at the connection between the elastic membrane 90 and the exposed, non-elastic membrane 48.

Figure 9A:
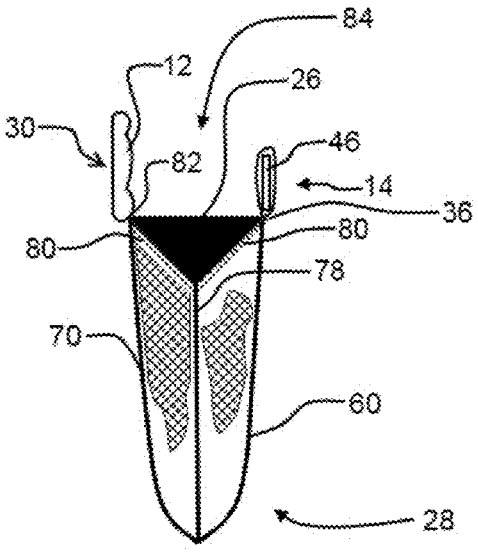
FIG. 9A is an interior side view of a pocket, in an embodiment.
Figure 9B:
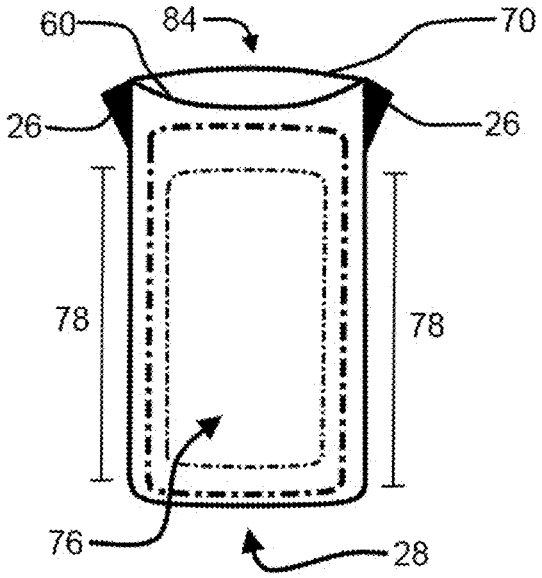
FIG. 9B is a front view of the pocket, in an embodiment.

FIG. 9A illustrates an interior side view (i.e., outer garment material not shown) of an embodiment of a secure invisible garment pocket. The pocket includes front and rear walls 60, 70 attached together to form a horizontal pocket opening 84 (FIG. 9B). The horizontal top on the front wall 60 (FIG. 9B) is attached 36 behind the exposed portion of the strap 14, or to the fabric 56 (FIG. 7) covering the strap 14; the horizontal top on the rear wall 70 (FIG. 9B) is attached 82 adjacent and behind the exposed strap 14 on the waistband 30. The pocket lining 28 may consist of, but is not limited to, elastane, microfibers, nylon, polyester, a water proof fabric or a mesh fabric. The pocket lining material 28 may have a low coefficient of friction to prevent items with a high coefficient of friction, such as but not limited to cell phone cases or rubber key chains, from getting caught on the pocket lining 28. An optional triangular stretchy material 26 may be sewn or otherwise attached 80 to both the front and rear pocket walls 60, 70. This optional triangular-shaped stretchy material 26 may extend down vertically from the top of the horizontal pocket opening 84 between front and rear walls 60, 70. Front and rear walls 60, 70 meet where the stretchy material tapers to a point. Stretchy material 26 may be on one or both sides of the pocket. The vertical side 78 of the pocket lining 28 may be sewn or otherwise attached 78 to the join seams 20 to reduce movement of the pocket lining 28 when the garment 10 is worn.

FIG. 9B illustrates a front view of a typical embodiment of the pocket lining 28. Furthermore, FIG. 9B depicts a cell phone/mp3 player 76 placed in the pocket lining 28. The optional stretchy material 26 may be made of, but is not limited to, polyester or spandex. The optional stretchy material 26 allows the pocket to open with greater range. The vertical sides 78 of the pocket lining 28, which is made up of front and rear walls 60, 70, can be sewn or otherwise attached to the two join seams 20 (FIG. 5A).

Figure 9C:
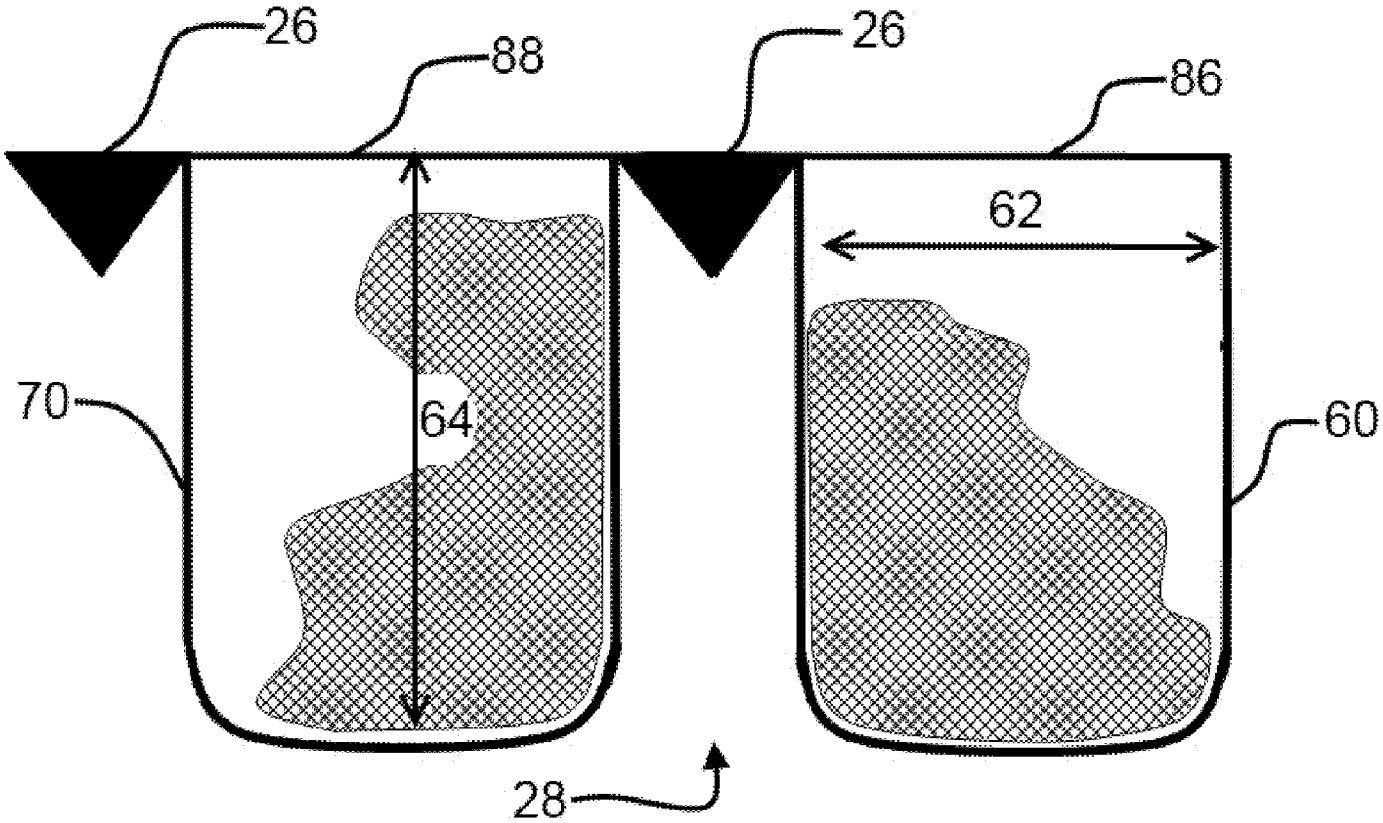
FIG. 9C is a front view of front and rear pocket linings that form one complete pocket, in an embodiment.

FIG. 9C depicts the front and rear walls 60, 70 that when sewn together form a complete horizontal pocket opening 84 (FIG. 9B). The horizontal top 86 on the front wall 60 may be sewn or otherwise attached 36 (FIG. 9A) to the exposed portion of the strap 14 or the fabric 56 (FIG. 7) that covers the strap 14. The horizontal top 88 on the rear wall 70 may be sewn or otherwise attached 82 (FIG. 9A) to the adjacent fabric situated behind the exposed portion of the strap 14, shown in the Figures as the waistband 30 (FIG. 9A). The dimensions of the pockets: length 62, depth 64 and width 66 are not limited. Any length 62, depth 64 and or width 66 of the pocket lining 28 may be acceptable depending on the application. Pocket size may vary depending on desired intended use of the garment 10. The two optional stretchy materials 26 may include, but are not limited to, polyester and/or spandex. Stretchy materials 26 may be in a variety of shapes and sizes, as may the front and rear walls 60, 70.

What is claimed is:

1. A garment, comprising:

a main portion comprising a waistband; and one or more pockets each comprising a pouch and an elastic strap;

wherein opposite ends of the elastic strap extends into separate slits in the waistband, such that the elastic strap inserts into the waistband;

wherein an opening of the pocket is formed between a portion of the elastic strap and an adjacent portion of the waistband; and wherein a top of the pouch is attached on one side to the waistband and is operably connected on the opposite side to the elastic strap such that the opposite side moves together with the elastic strap.

2. The garment according to claim 1, wherein the main portion comprises a right hip panel and right leg section and at least two seams attaching the right hip panel to the right leg section at left and right sides of the right hip panel, and a left hip panel and left leg section and at least two seams attaching the left hip panel to the left leg section at left and right sides of the left hip panel.

3. The garment according to claim 2, wherein a top of at least one of the hip panels is operably connected to the elastic strap such that a top portion of the hip panel moves together with the elastic strap.

4. The garment according to claim 2, wherein the elastic strap comprises a section of inelastic material and a stretchy membrane.

5. The garment according to claim 4, wherein the stretchy membrane extends into the slits in the waistband.

6. The garment according to claim 2, wherein the elastic strap is attached to the waistband in such a manner that the elastic strap provides no additional expansion to the waistband.

7. The garment according to claim 2, further comprising pieces of flexible fabric between a front side of the each hip panel and a front side of each respective leg section, and between a rear side of each hip panel and a rear side of each respective leg section.

8. The garment according to claim 2, wherein the garment is a lower body garment.

9. The garment according to claim 2, wherein opposite sides of the pouch are perpendicular to the waistband and attached to the at least two seams or an inner lining of the main portion.

10. The garment according to claim 1, wherein the opening of the pocket is configured to be parallel to an upper edge of the garment waistband.

11. The garment according to claim 2, wherein the elastic strap is a continuous loop strap.

12. The garment according to claim 2, wherein at least one of the hip panels comprises at least two hip panel slits, each hip panel slit having a top and a bottom, wherein each hip panel slit extends down from a top of the at least one hip panel along the seams, such that the at least one hip panel is not attached to any leg section along the length of the hip panel slits.

13. The garment according to claim 2, wherein the pouch tapers such that its bottom width is less than its top width.

14. The garment according to claim 1, wherein the pouch comprises a rear panel having top and bottom portions and a front panel having top and bottom portions, wherein the rear panel top portion is operably attached to the waistband and the front panel top portion is operably connected to the elastic strap, such that the front panel top portion moves together with the elastic strap.

15. The garment according to claim 14, wherein the top horizontal width of at least one of the hip panels is equal to the distance between the slits in the waistband.

16. The garment according to claim 14, wherein a stretchy material is attached to and between the top portions of the front and rear panels of the pouch, wherein the stretchy material extends down from the top of the front and rear panels in a tapered fashion, terminating at a point where the front and rear panels of the pouch meet.

17. A lower body garment, comprising:

a main portion comprising a waistband; and at least one pocket comprising an elastic band;

wherein at least one end of the elastic band extends into a slit in the waistband and the elastic band is secured to the waistband such that the elastic band provides no additional expansion to the waistband;

wherein a section of the band that does not extend into the slit and an adjacent portion of the waistband together forms an opening of the pocket; and wherein the pocket comprises a pouch comprising a first face and a second face, wherein an upper section of the first face is operably connected to the elastic band such that the elastic band and upper section of the first face move together, and wherein an upper section of the second face is secured to an adjacent section of the waistband.

18. The lower body garment according to claim 17, wherein an exterior fabric covers the section of band that does not extend into the slit.

19. The garment according to claim 17, further comprising a slit in the main portion corresponding to each of the at least one pocket, extending down from a bottom of the waistband directly below the slit in the waistband, that allows the elastic strap to extend farther away from the user's body.

20. A garment, comprising:

a main portion; and a pocket comprising a pouch and an elastic strap;

wherein at least one end of the elastic strap extends into an opening in the main portion, and the elastic strap is secured to the main portion;

wherein an opening of the pocket is formed between a portion of the elastic strap and the main portion of the garment; and wherein a top of the pouch is attached on one side to the main portion and is operably connected on the opposite side to the elastic strap such that the opposite side moves together with the elastic strap, wherein the main portion comprises a right hip panel and right leg section and at least two seams attaching the right hip panel to the right leg section, and a left hip panel and left leg section and at least two seams attaching the left hip panel to the left leg section, wherein a top of at least one of the hip panels is operably connected to the elastic strap such that a top portion of the hip panel moves together with the elastic strap, wherein the top horizontal width of one of the hip panels is within 20% of the width of an exposed portion of the strap that is not inside the opening in the main portion when the elastic strap is in a relaxed state.

* * * * *